US006591080B2

(12) United States Patent
Buchan

(10) Patent No.: US 6,591,080 B2
(45) Date of Patent: Jul. 8, 2003

(54) LOOSE SLEEVE PRESSURE MEMBER

(75) Inventor: William R. Buchan, Pocasset, MA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/814,334

(22) Filed: Mar. 21, 2001

(65) Prior Publication Data

US 2002/0136571 A1 Sep. 26, 2002

(51) Int. Cl.[7] ..... G03G 15/16
(52) U.S. Cl. ..... 399/307; 399/331; 399/332
(58) Field of Search ..... 399/307, 320, 399/331, 332, 333, 335, 339; 219/619, 670, 671; 492/4, 47, 48

(56) References Cited

U.S. PATENT DOCUMENTS 4,377,336 A * 3/1983 Parks ..... 399/331
4,894,687 A * 1/1990 Beaudet ..... 399/307
4,903,597 A * 2/1990 Hoage et al. ..... 492/4 X
5,737,679 A * 4/1998 Uehara et al. ..... 399/329
5,974,294 A * 10/1999 Tange ..... 399/328
6,035,174 A * 3/2000 Ito et al. ..... 399/328
6,393,249 B1 * 5/2002 Aslam et al. ..... 399/333

FOREIGN PATENT DOCUMENTS

EP 0 181 726 * 5/1986

* cited by examiner

*Primary Examiner*—Hoan Tran
(74) *Attorney, Agent, or Firm*—Oliff & Berridge, PLC

(57) ABSTRACT

A pressure member is provided suitable for use in an image forming system. The pressure member includes a core surrounded by a sleeve. The inner perimeter of the sleeve is large than the outer perimeter of the core to enable the sleeve to be removed and replaced easily when worn out.

13 Claims, 3 Drawing Sheets

LOOSE SLEEVE PRESSURE MEMBER

TECHNICAL FIELD

The present invention relates generally to printing in image forming systems, and specifically relates to pressure members in such systems.

BACKGROUND OF THE INVENTION

Conventional image forming systems, such as toner imaging systems, where a latent charge image is developed with a pigmented toner before being transferred to a substrate, such as a sheet of paper, are widespread in the office and home. The latent image is formed on an imaging member with a charge-emitting device, and then developed with the toner. The developed image is ultimately transferred to the substrate to form a printed image.

Many technologies exist for forming a latent charge image, including optical image projection onto a charged photoconductive belt or drum, charging a dielectric member with an electrostatic pin array or electron beam, and charge projection from an ionographic print cartridge or from a plasma generator. Once a latent image is formed by any of these methods, the image may be developed with a toner before transferring the image to the substrate.

The developed image is transferred from a transfer member to the substrate. In some image forming systems the imaging member is also the transfer member, which transfers the developed image directly onto the substrate. In other image forming systems, the imaging member first transfers the developed image to a distinct transfer member, which then transfers the developed image to the substrate.

In general, there are at least three methods of producing the final image on a substrate. In the heating method, the toned image is heated to dry or fix the image on the substrate during the final stage of printing. In the transfusing method, the toned image is simultaneously transferred to and fixed on the substrate in a melted or fused state. By controlling the temperature, the relative tackiness, or the self-adherence of the heated toner, may be made to vary to achieve optimal transfer of the image. Finally, in the transfixing method, the final image may be produced by applying pressure, instead of heat, on either side of the substrate to transfer the image from the transfer member to the substrate. This pressure may be applied with a heavy pressure roll. Other methods of producing the final image on the substrate may include a hybrid of these methods, where, for example, some heat and pressure may be applied to transfer the image.

In the aforementioned methods of producing the final image on a substrate, pressure members, such as pressure rolls, can play an important role. The substrate is sandwiched between the transfer member and a pressure member at the transfuse nip. The transfer member applies a force to one side of a substrate while the pressure member applies a force on the opposite side of the substrate, thereby facilitating the transfer of the image from the transfer member to the substrate. The pressure exerted by the pressure member can exceed 2000 lb/in$^2$ to effectively transfer the image onto the substrate. The pressure member should ideally be able to withstand these high pressures, and be rigid in order to apply this pressure evenly.

To withstand the high pressure, and provide rigidity, the pressure member can weigh upwards of 40 lbs., and be composed of a metal or alloy, such as an aluminum alloy or steel. Despite the strength of the constituent materials of the pressure member, however, the surface of the pressure member can be damaged by, for example, wrinkled paper passing through the transfuse nip. This type of damage is more likely when the substrate is a continuous web instead of a cut sheet. When the web mistracks, wrinkles can develop in the paper. These wrinkles can cause permanent deformation of the pressure member due to the high pressure, thus impairing printing quality.

SUMMARY OF THE INVENTION

To solve the aforementioned problems, a pressure member having a sleeve is provided suitable for use in an image forming system. The pressure member includes a core surrounded by the sleeve. The inner perimeter of the sleeve is larger than the outer perimeter of the core to enable the sleeve to be removed and replaced easily when worn out. Replacing the sleeve, instead of the entire, and much heavier, pressure role facilitates the maintenance of the image forming member, and reduces costs.

In particular, a pressure member suitable for use in an image forming system is provided. The member includes a core, and a sleeve removably and replaceably disposed around the core. The core may have an outer perimeter, and the sleeve may have an inner perimeter such that the inner perimeter of the sleeve is larger than the outer perimeter of the core to permit the sleeve to be removed from the core and replaced by a new sleeve. The inner perimeter of the sleeve may be about 2% larger than the outer perimeter of the core. At least one of the core and the sleeve may be formed of a metallic alloy, such as steel and/or aluminum alloy.

The core may include a cylinder and the sleeve may include a coaxial cylindrical shell disposed around the cylinder of the core, the inner circumference of the cylindrical shell being larger than the circumference of the cylinder of the core. The core may further include a flange formed at one end thereof to prevent the sleeve from separating from the core at that end.

Also provided below, suitable for use in an imaging forming system, is a pressure member including a core having a periphery, and a sleeve disposed about the core in intimate facing contact with only a portion of the periphery of the core, thereby allowing removal of the sleeve from the core.

DETAILED DESCRIPTION OF THE INVENTION

A pressure member suitable for use in an image forming system is described herein. Image forming systems include electrophotographic, electrostatic or electrostatographic, ionographic, ink-jet, and other types of image forming or reproducing systems that are adapted to capture and/or store image data associated with a particular object, such as a document. The system of the present invention is intended to be implemented in a variety of environments, such as in any of the foregoing types of image forming systems, and is not limited to the specific systems described below.

Figure 1:
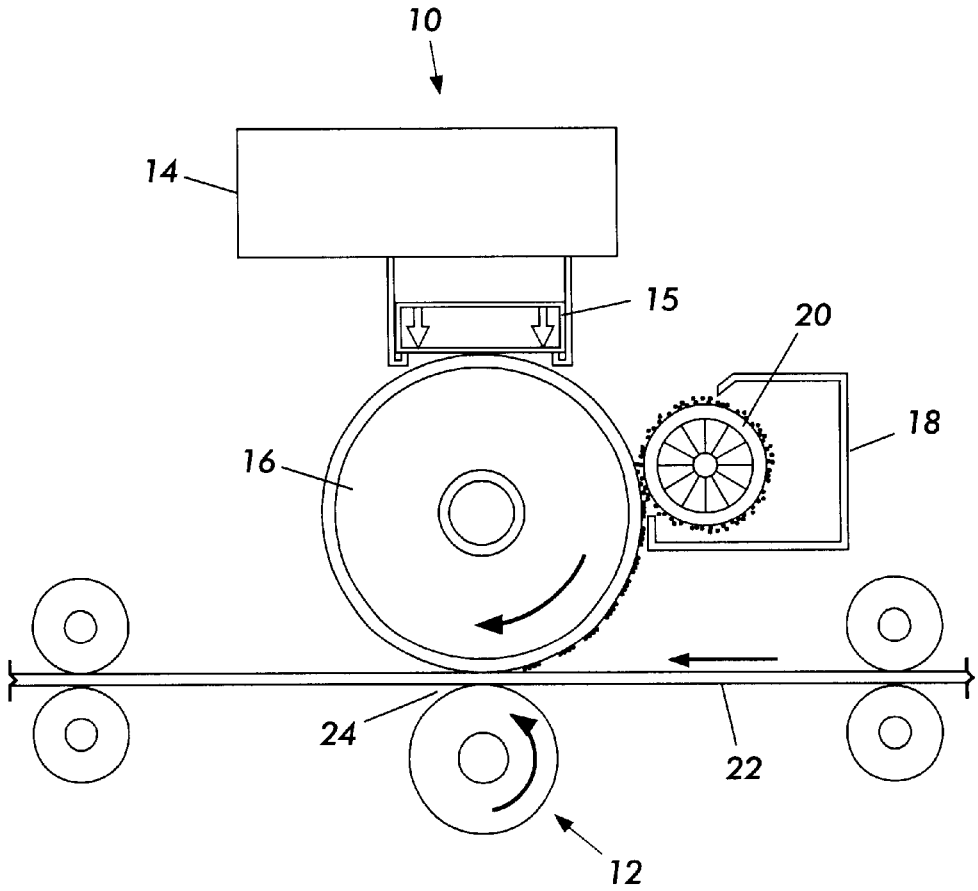
FIG. 1 is a schematic representation of an image forming system having a pressure member according to the teachings of the present invention.

Referring to FIG. 1, an image forming system 10 is shown including a pressure member 12. The image forming system 10 includes an imaging center 14 and an imaging and transfer member 16. The system 10 further includes an image developer station 18 having a magnet roll 20.

The imaging center 14 has a charge-emitting device 15, such as an electron beam imaging head, for forming a latent image on a dielectric surface of the imaging and transfer member 16. The latent image may then be developed with toner particles from the magnet roll 20. The image developer 18 encases the magnet roll 20, and houses and conditions the toner prior to the application of the toner on the imaging and transfer member 16. The developed image may then be transferred to a substrate 22, such as a sheet of paper, at a transfuse nip 24 formed between the imaging and transfer member 16 and the pressure member 12.

The image forming system 10 shown in FIG. 1 is of the type where the imaging member, the device on which the latent image is formed, and the transfer member, the device that directly transfers the developed image to the substrate, are coincident. Thus, the imaging and transfer member 16 functions as both a device to form an image thereon, and as a device to transfer the image onto the substrate 22. In other embodiments, the imaging member may first transfer the developed image onto a distinct transfer member, before the transfer member transfers the image to the substrate. The distinct transfer member can be a drum, or belt, for example.

Figure 2:
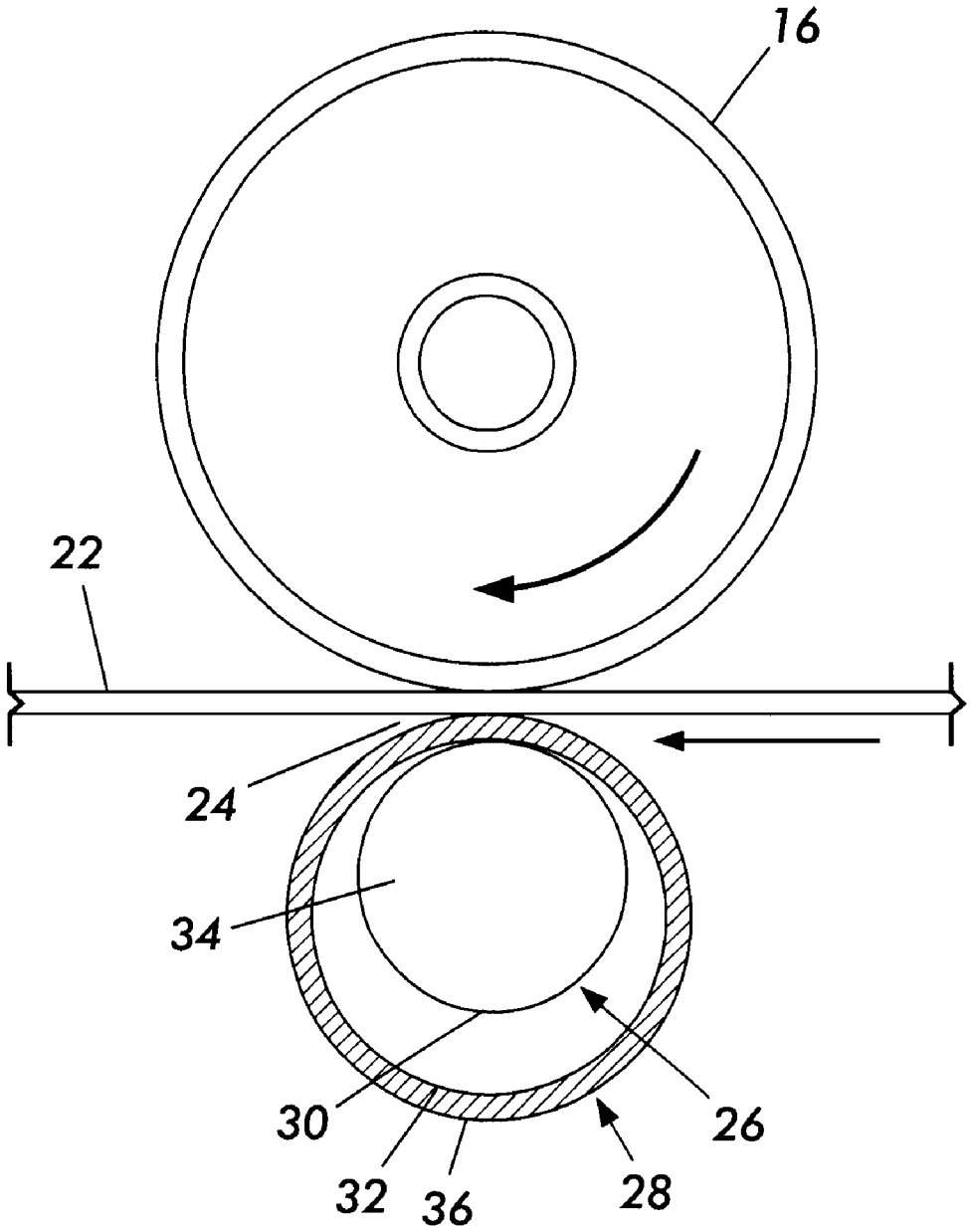
FIG. 2 is a schematic representation of a pressure member according to the teachings of the present invention.

Referring to FIG. 2, a pressure member 12 consistent with the principles of the present invention is shown. A transfuse nip 24 is formed between the imaging and transfer member 16 and the pressure member 12. The pressure member 12 includes any device that may be used in an image forming system, which applies pressure to an object to facilitate the task of forming an image on a substrate. For example, the pressure member can be used to apply pressure to the substrate at the transfuse nip, while the transfer member applies an opposing pressure, to facilitate the transfer and/or fusing of the image to the substrate. The pressure member 12 includes a core 26, and a sleeve 28 removably and replaceably disposed about the core 26. The core 26 has an outer perimeter 30, and the sleeve 28 has an inner perimeter 32. The inner perimeter 32 of the sleeve 28 is larger than the outer perimeter 30 of the core 26. In one embodiment, the inner perimeter 32 of the sleeve 28 is about 2% larger than the outer perimeter 30 of the core 26. In one example, a 1.5 inch diameter sleeve was fitted on a core that had a diameter that was 0.03 inches smaller. The core 26, and the sleeve 28 may include a metallic alloy, such as an aluminum alloy, or steel.

In one embodiment of the present invention, the core 26 includes a cylinder 34 and the sleeve 28 includes a coaxial cylindrical shell 36, resembling a pipe with open ends, disposed around the core 26. The inner circumference 32 of the cylindrical shell 36 is larger than the circumference 30 of the cylinder 34 of the core 26.

The pressure member 12 helps transfer and fuse the developed image from the imaging and transfer member 16 onto the substrate 22 by applying a force to one side of the substrate 12, while the member 16 applies a force on the opposite side of the substrate at the transfuse nip 24. As the substrate passes through the transfuse nip 24, the simultaneous forces exerted at the nip 24 by the member 16 and the pressure member 12 help to pressure fuse the developed image onto the substrate 22.

Wear and tear on the pressure member 12, such as deformations on the outer surface of the sleeve 28 caused by wrinkles in the substrate, eventually results in impaired print quality. Instead of replacing the entire pressure member 12, the pressure member 12 is adapted to allow replacement of just the sleeve 28. Because the inner circumference 32 of the cylindrical shell 36 of the sleeve 28 is larger than the circumference 30 of the cylinder 34 of the core 26, it does not require much effort to remove the sleeve 28 from the core 26, and to replace it with a new sleeve. These features obviate the need to replace the entire pressure member 12, which can weigh upwards of 40 lbs. There is therefore a savings in both effort and materials, and hence cost, by employing the pressure member of the present invention.

Figure 3:
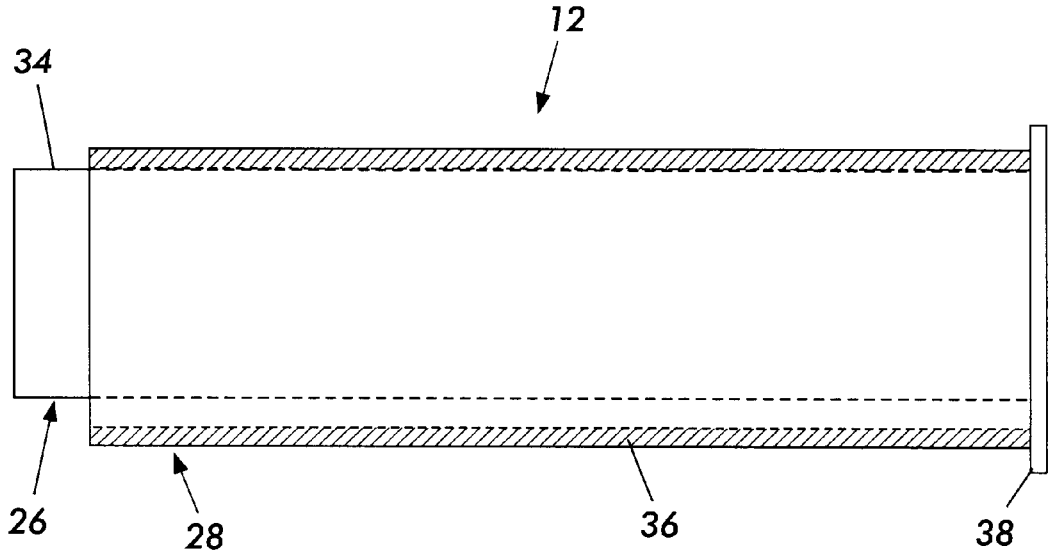
FIG. 3 is a schematic representation of a side view of a pressure member according to the teachings of the present invention.

Referring to FIG. 3, a side view of a pressure member 12 consistent with the teachings of the present invention is shown. The pressure member 12 includes a core 26 and a sleeve 28 removably and replaceably disposed around the core 26. The core 26 includes a cylinder 34 and the sleeve 28 includes a coaxial cylindrical shell 36 disposed around the core 26. The inner circumference 32 of the cylindrical shell 36 is larger than the circumference 30 of the cylinder 34 of the core 26. The core 26 further includes a flange 38 disposed on a surface of the core to prevent the sleeve 28 from inadvertently, or accidentally separating from the core 26.

In operation, a latent image is formed on the imaging and transfer member 16 by a charge-emitting device included in the imaging center 14. The latent image is developed on the imaging and transfer member using toner particles from magnet roll 20 included in the image developer 18. Next, the imaging and transfer member rotates to bring the developed image to the transfuse nip 24 formed between the imaging and transfer member 16 and the pressure member 12. As the substrate 22 passes through the nip 24, the imaging and transfer member 16 and the pressure member 12 rotate and exert pressure on the two sides of the substrate 22. The pressure facilitates the transfer of the developed toner form the imaging and transfer member 16 to the substrate 22. As can be seen in FIG. 2, when in operation, the sleeve 28 is in intimate contact with the core 26 near the nip and not at other locations.

When the pressure member 16 becomes worn, the sleeve 28 alone need be replaced. Because the inner circumference 32 of the cylindrical shell 36 of the sleeve 28 is larger than the circumference 30 of the cylinder 34 of the core 26, it does not require much effort to remove the sleeve 28 from the core 26, and to replace it with a new sleeve.

It should be understood that although the above description has described the use of pressure rolls in transfuse nips, where some heating may be involved to fuse the image onto the substrate, the use of pressure roles consistent with the principles of the present invention can also be used in transfix nips. In transfix nips, pressure is mainly used to transfer the image to the substrate.

Those skilled in the art will recognize, or be able to ascertain using no more than routine experimentation, many equivalents to the specific embodiments and methods described herein. Such equivalents are intended to be encompassed by the scope of the following claims.

What is claimed:

1. A pressure member suitable for use in an image forming system, the member comprising:

a core having a periphery; and a sleeve removably and replaceably disposed around the core in intimate rolling contact with only a portion of the periphery of the core, wherein the core has an outer perimeter, and the sleeve has an inner perimeter, the inner perimeter of the sleeve being about 2% larger than the outer perimeter of the core to permit the sleeve to be removed form the core and replaced by a new sleeve.

2. The pressure member of claim 1, wherein at least one of the core and the sleeve is formed of a metallic alloy.

3. The pressure member of claim 2, wherein the metallic alloy includes at least one of steel and an aluminum alloy.

4. The pressure member of claim 1, wherein the core includes a cylinder and the sleeve includes a coaxial cylindrical shell disposed around the cylinder of the core, the inner circumference of the cylindrical shell being larger than the circumference of the cylinder of the core.

5. The pressure member of claim 4, wherein the inner circumference of the cylindrical shell is about 2% larger than the circumference of the cylinder of the core.

6. The pressure member of claim 4, wherein at least one of the core and the sleeve is formed of a metallic alloy.

7. The pressure member of claim 6, wherein the metallic alloy includes at least one of steel and an aluminum alloy.

8. The pressure member of claim 4, wherein the core further comprises a flange formed at one end thereof to prevent the sleeve from separating from the core at that end.

9. In an imaging forming system, a pressure member comprising a core having a periphery; and a sleeve disposed about the core in intimate rolling contact with only a portion of the periphery of the core, thereby allowing removal of the sleeve from the core, wherein the core has an outer perimeter, and the sleeve has an inner perimeter, the inner perimeter of the sleeve being about 2% larger than the outer perimeter of the core to permit the sleeve to be removed form the core and replaced by a new sleeve.

10. The pressure member of claim 9, wherein the core further comprises a flange formed at one end thereof.

11. The pressure member of claim 9, wherein the sleeve is formed of a metallic alloy.

12. A method of manufacturing a pressure member suitable for use in an image forming system, the method comprising the steps of:

providing a core; and removably and replaceably disposing a sleeve around the core so that the sleeve is in intimate rolling contact with only a portion of the core, wherein the core has an outer perimeter, and the sleeve has an inner perimeter, the inner perimeter of the sleeve being about 2% larger than the outer perimeter of the core to permit the sleeve to be removed form the core and replaced by a new sleeve.

13. The method of claim 12, further comprising the step of forming a flange on one end of the core to prevent the sleeve from separating from the core at that end.

* * * * *